US009531062B2

(12) United States Patent
Park et al.

(10) Patent No.: US 9,531,062 B2
(45) Date of Patent: Dec. 27, 2016

(54) COMMUNICATION SYSTEM

(71) Applicants: Samsung Electronics Co., Ltd., Suwon-si (KR); Industry-Academic Cooperation Foundation, Yonsei University, Seoul (KR)

(72) Inventors: Kun-kook Park, Suwon-si (KR); Young-jun Hong, Seoul (KR); Byung-hoon Ko, Hwaseong-si (KR); Tae-wan Koo, Seoul (KR); Ji-kwon Kim, Seoul (KR); Kun-soo Shin, Seongnam-si (KR); Jong-gwan Yook, Seoul (KR)

(73) Assignees: Samsung Electronics Co., Ltd., Suwon-si (KR); Industry-Academic Cooperation Foundation, Yonsei University, Seoul (KR)

( * ) Notice: Subject to any disclaimer, the term of this patent is extended or adjusted under 35 U.S.C. 154(b) by 479 days.

(21) Appl. No.: 13/742,711

(22) Filed: Jan. 16, 2013

(65) Prior Publication Data

US 2013/0181874 A1 Jul. 18, 2013

(30) Foreign Application Priority Data

Jan. 16, 2012 (KR) ..... 10-2012-0004911

(51) Int. Cl.
*H01Q 1/27* (2006.01)
*H01Q 1/38* (2006.01)
(Continued)

(52) U.S. Cl.
CPC ..... *H01Q 1/273* (2013.01); *H01Q 1/38* (2013.01); *H01Q 5/371* (2015.01); *H01Q 7/00* (2013.01);
(Continued)

(58) Field of Classification Search
CPC ..... H01Q 1/273
See application file for complete search history.

(56) References Cited

U.S. PATENT DOCUMENTS 4,771,291 A * 9/1988 Lo et al. ..... 343/700 MS
5,565,875 A 10/1996 Buralli et al.
(Continued)

FOREIGN PATENT DOCUMENTS

CN 201 590 480 U 9/2010
EP 1 006 605 A1 6/2000
(Continued)

OTHER PUBLICATIONS

Extended Euopean Search Report issued on Aug. 4, 2014, in counterpart European Application No. 13151494.5 (9 pages, in English).
(Continued)

*Primary Examiner* — Hoang V Nguyen
*Assistant Examiner* — Michael Bouizza
(74) *Attorney, Agent, or Firm* — NSIP Law

(57) ABSTRACT

A wearable communication system including an antenna pattern configured to transmit or receive a radio-frequency (RF) signal, a main board configured to control the wearable communication system, and a power supply unit configured to supply power to the main board, wherein the antenna pattern is spaced apart from the main board and the power supply unit.

26 Claims, 10 Drawing Sheets

(51) Int. Cl.

| | |
|---|---|
| ***H01Q 9/04*** | (2006.01) |
| ***H01Q 9/42*** | (2006.01) |
| ***H01Q 7/00*** | (2006.01) |
| ***H01Q 5/371*** | (2015.01) |

(52) U.S. Cl.
CPC ..... *H01Q 9/0421* (2013.01); *H01Q 9/0457* (2013.01); *H01Q 9/42* (2013.01)

(56) References Cited

U.S. PATENT DOCUMENTS

| | | | | |
|---|---|---|---|---|
| 2001/0050635 | A1 | 12/2001 | Weinberger | |
| 2003/0011521 | A1 | 1/2003 | Edimo et al. | |
| 2003/0025637 | A1 | 2/2003 | Mendolia et al. | |
| 2003/0169207 | A1* | 9/2003 | Beigel | 343/718 |
| 2007/0281763 | A1 | 12/2007 | Durand et al. | |
| 2009/0197653 | A1* | 8/2009 | Mizoguch | H01Q 1/273 455/575.7 |
| 2011/0057042 | A1 | 3/2011 | Duggan et al. | |
| 2011/0095947 | A1 | 4/2011 | Chou | |
| 2011/0166614 | A1 | 7/2011 | Abrahamson et al. | |
| 2011/0175783 | A1 | 7/2011 | Kim | |
| 2011/0193754 | A1 | 8/2011 | Schlub et al. | |
| 2011/0295102 | A1* | 12/2011 | Lakkis et al. | 600/407 |

FOREIGN PATENT DOCUMENTS

| | | | |
|---|---|---|---|
| EP | 1 646 109 | A1 | 4/2006 |
| EP | 2 065 971 | A1 | 6/2009 |
| JP | 2010-21756 | A | 1/2010 |
| KR | 0133145 | B1 | 12/1997 |
| KR | 10-2006-0049406 | A | 5/2006 |
| KR | 10-2011-0060389 | A | 6/2011 |

OTHER PUBLICATIONS

A. Christ et al., "The Dependence of Electromagnetic Far-Field Absorption on Body Tissue Composition in the Frequency Range From 300 MHz to 6 GHz," *IEEE Transactions on Microwave Theory and Techniques*, vol. 54, No. 5, May 2006, pp. 2188-2195.

Z. Duan et al., "Improving Wearable Slot Antenna Performance with EBG Structures," *Proceedings of the 2008 Loughborough Antennas & Propagation Conference* (*LAPC 2008*), Mar. 17-18, 2008, Loughborough University, Loughborough, UK, pp. 173-176.

N. Chahat et al., "A Compact UWB Antenna for On-Body Applications," *IEEE Transactions on Antennas and Propagation*, vol. 59, No. 4, Apr. 2011, pp. 1123-1131.

Partial European Search Report issued Mar. 20, 2014 in counterpart European Patent Application No. 13151494.5. (7 pages in English).

* cited by examiner

COMMUNICATION SYSTEM

CROSS-REFERENCE TO RELATED APPLICATIONS

This application claims the benefit of Korean Patent Application No. 10-2012-0004911 filed on Jan. 16, 2012, in the Korean Intellectual Property Office, the disclosure of which is incorporated herein by reference in its entirety for all purposes.

BACKGROUND

1. Field

This application relates to wearable communication systems.

2. Description of Related Art

As the population of the aged has increased, research has been actively conducted on a communication system that may be implanted into the body of a patient, adhered onto or outside the body of the patient, or worn by the patient to collect medical information of the patient. Such a communication system is capable of measuring a bio-signal from a human body, transmitting the bio-signal wirelessly, and receiving data from the outside wirelessly.

SUMMARY

In one general aspect, a wearable communication system includes an antenna pattern configured to transmit or receive a radio-frequency (RF) signal; a main board configured to control the wearable communication system; and a power supply unit configured to supply power to the main board; wherein the antenna pattern is disposed above the main board and the power supply unit.

The antenna pattern, the main board, and the power supply unit may be disposed in a stack; and the antenna pattern may be disposed in an upper portion of the stack.

The main board may include an RF controller configured to control RF communication in the wearable communication system, the RF controller being disposed in a region of the main board; and the antenna pattern may be disposed on an opposite side of the region of the main board not to face the RF controller.

The wearable communication system may further include a medium disposed below the antenna pattern; and the medium may comprise a material having a loss tangent that is lower than a loss tangent of polydimethylsiloxane (PDMS).

The wearable communication system may further include a medium disposed below the antenna pattern; and the medium may comprise a material having a loss tangent of less than 0.025.

The wearable communication system may further include a medium disposed below the antenna pattern; and the medium may comprise any one of Kapton polyimide, RT/duroid 5880, RT/duroid RT 6010LM, and FR-4.

The wearable communication system may further include a medium disposed below the antenna pattern; and the medium may comprise a material having a loss tangent effective to increase a radiation efficiency of the wearable communication system at a resonant frequency of an RF signal radiated from the antenna pattern.

The main board may include an RF controller configured to control RF communication in the wearable communication system; the wearable communication system may further include at least one connection unit connecting the antenna pattern to the RF controller; and the at least one connection unit may pass through a space between the antenna pattern and the main board.

The wearable communication system may further include a ground plane for the antenna pattern; and the ground plane may be disposed in the main board or the power supply unit.

The power supply unit may include a coating on a surface of the power supply unit closest to the antenna layer; and the coating may be the ground plane.

The wearable communication system may further include at least one shorting pin connecting the antenna pattern to the ground plane.

The at least one shorting pin may pass through a space between the antenna pattern and the main board.

The wearable communication system may further include an antenna layer including the antenna pattern; and at least one interconnect via hole in the antenna layer.

The wearable communication system may further include at least one interconnect via hole in the main board; and the antenna layer may be connected to the main board via the at least one interconnect via hole in the antenna layer and the at least one interconnect via hole in the main board.

The wearable communication system may further include an antenna layer including the antenna pattern; and a middle connection layer disposed between a surface of the antenna layer closest to the main board and a surface of the main board closest to the antenna layer.

The antenna pattern may be configured to have a unidirectional radiation pattern.

The antenna pattern may be configured to transmit or receive the RF signal based on wireless body area network (WBAN) technology.

The wearable communication system may have a thickness that is less than or equal to 1.5 mm.

The main board may include a flexible printed circuit board (FPCB); and any one or any combination of an RF controller, a power controller, and a logic controller may be inserted into or embedded in the FPCB.

The FPCB may be an embedded FPCB in which the any one or any combination of the RF controller, the power controller, and the logic controller is embedded.

The main board may be a main board that was manufactured using an active embedding process.

The main board may further include a connector connecting the RF controller, the power controller, and the logic controller to one another.

The antenna pattern may be a planar inverted-F antenna (PIFA) pattern or a slotted patch antenna pattern.

The antenna pattern may be a slotted patch antenna pattern; the slotted patch antenna pattern may include a main patch, and an edge loop separated from the main patch by a space; the slotted patch antenna pattern may be configured to receive an RF signal from the main board via the edge loop; and a resonant frequency and a wavelength of an RF signal radiated from the slotted patch antenna pattern may be adjustable by adjusting a size of the space between the edge loop and the main patch.

The antenna pattern may be a slotted patch antenna pattern; the slotted patch antenna pattern may include a main patch having at least one slot, and an edge loop separated from the main patch by a space; and a resonant frequency and a wavelength of an RF signal radiated from the slotted patch antenna pattern may be adjustable by adjusting a number of the at least one slot and a length of each of the at least one slot.

The antenna pattern may be a slotted patch antenna pattern; the slotted patch antenna pattern may include a main patch, and an edge loop separated from the main patch by a space; and a resonant frequency and a wavelength of an RF signal radiated from the slotted patch antenna pattern may be adjustable by adjusting a thickness of the edge.

In another general aspect, a wearable communication system configured to be wearable by a user includes an antenna pattern configured to transmit and receive a radio-frequency (RF) signal; an electrode layer configured to contact a body surface of the user when the wearable communication system is being worn by the user; and a main board configured to control the wearable communication system; wherein the main board is disposed between the antenna pattern and the electrode layer, and is spaced apart from the antenna pattern.

The wearable communication system may further include a power supply unit configured to supply power to the main board; and the power supply unit may be disposed between the main board and the electrode layer, or may be disposed side-by-side with the main board.

The wearable communication system may further include an antenna layer including the antenna pattern; and a plurality of through via holes filled with a conductive material connecting the antenna layer to the main board; wherein the through via holes may be located along perimeters of the antenna layer and the main board.

Other features and aspects will be apparent from the following detailed description, the drawings, and the claims.

DETAILED DESCRIPTION

Figure 1:
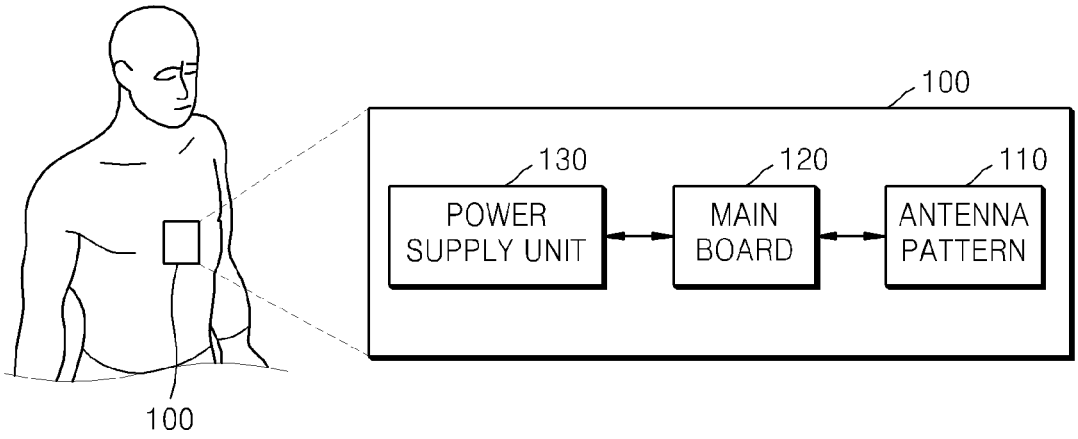
FIG. 1 is a block diagram of an example of a communication system.

The following detailed description is provided to assist the reader in gaining a comprehensive understanding of the methods, apparatuses, and/or systems described herein. However, various changes, modifications, and equivalents of the methods, apparatuses, and/or systems described herein will be apparent to one of ordinary skill in the art. Also, descriptions of functions and constructions that are well known to one of ordinary skill in the art may be omitted for increased clarity and conciseness.

Throughout the drawings and the detailed description, the same reference numerals refer to the same elements. The drawings may not be to scale, and the relative size, proportions, and depiction of elements in the drawings may be exaggerated for clarity, illustration, and convenience.

FIG. 1 is a block diagram of an example of a communication system 100. Referring to FIG. 1, the communication system 100 includes an antenna pattern 110, a main board 120, and a power supply unit 130.

For convenience of explanation, FIG. 1 illustrates only elements of the communication system 100 that are related to the current example. However, it will be apparent to one of ordinary skill in the art that the communication system 100 may also include other general elements.

In this example, the communication system 100 is a wearable antenna, but is not limited thereto, and the communication system 100 may instead be an implantable antenna. The wearable antenna may be adhered onto the skin of a human body, but is not limited thereto.

For example, if the communication system 100 is a wearable antenna, the communication system 100 may communicate with an implantable antenna implanted into a human body and/or external devices outside the human body.

For convenience of explanation, it will hereinafter be assumed that the communication system 100 is a wearable antenna that may communicate with external devices outside a human body, but the communication system 100 is not limited thereto.

The antenna pattern 110 transmits and/or receives a radio-frequency (RF) signal. For example, the antenna pattern 110 may exchange RF signals with an external device that is a communication target.

In this example, the antenna pattern 110 is connected to a ground plane (not shown) to form a standing wave due to resonance of an RF signal.

The antenna pattern 110 may transmit and receive signals based on wireless body area networking (WBAN) technology, but is not limited thereto. More specifically, the antenna pattern 110 may use medical WBAN technology or non-medical WBAN technology to transmit and receive signals depending on its usage. Also, the antenna pattern 110 may transmit and receive signals in a frequency band of 2.4 GHz according to the WBAN technology, but is not limited thereto.

The antenna pattern 110 is formed of a conductor, which may be copper, or gold, or any other metal that conducts electricity. An antenna layer (not shown in FIG. 1, but shown in FIGS. 2A-3B) may be formed by adhering the antenna pattern 110 to a flexible polyimide layer having an insulating property using an adhesive layer. Thus, the antenna layer may include the antenna pattern 110, the adhesive layer, and the polyimide layer.

The antenna pattern 110 may produce a unidirectional radiation pattern. In this regard, the antenna pattern 110 may have a pattern effective to produce a unidirectional radiation pattern. For example, the antenna pattern 110 may have a ground plane, like a microstrip patch antenna or a monopole antenna, and may thus produce a unidirectional radiation pattern. Since the antenna pattern 110 produces a unidirectional radiation, it is possible to reduce an amount of power radiated toward a human body, thereby increasing the radiation efficiency of the communication system 100. The antenna pattern 110 may be formed in any of various patterns as will be described in detail with reference to FIGS. 4A and 4B below.

The main board 120 controls the communication system 100. For example, the main board 120 may have a structure in which an analog chip and/or an RF chip is adhered onto, mounted on, inserted into, or embedded in a printed circuit board (PCB), but is not limited thereto, and the main board 120 may also include other chips for performing other functions. The PCB may be a flexible printed circuit board (FPCB).

The power supply unit 130 supplies power to the main board 120. For example, the power supply unit 130 may be a battery. In this example, the battery is a flexible battery.

The antenna pattern 110 is stacked with the main board 120 and the power supply unit 130. When a user wears the communication system 100, the antenna pattern 110 is disposed farthest from the body of the user, and the distance between the antenna pattern 110 and the body of the user is large. Accordingly, the communication system 100 may have a high radiation efficiency. This will be described in detail with reference to FIGS. 2A to 3B below.

The communication system 100 has a structure in which the antenna pattern 110, the main board 120, and the power supply unit 130 are stacked together, and the antenna pattern 110 is disposed in an upper portion of the communication system 100. In other words, in the communication system 100, the antenna pattern 110, the main board 120, and the power supply unit may be sequentially stacked, or the main board 120 and the power supply unit 130 may be arranged side-by-side and stacked with the antenna pattern 110. A structure in which the antenna pattern 110, the main board 120, and the power supply unit 130 are sequentially stacked will be described in detail with reference to FIGS. 2A and 2B below. A structure in which the main board 120 and the power supply unit 130 are arranged side-by-side and stacked with the antenna pattern 110 will be described in detail with reference to FIGS. 3A and 3B below. For example, the antenna pattern 110, the main board 120, and the power supply unit 130 may be stacked together by laminating.

The terms "upper" and "lower" as used in this application are relative to a body of a user wearing the communication system 100 regardless of the actual physical orientation of the communication system 100. An upper portion of the communication system 100 is further away from the body of the user than a lower portion of the communication system 100.

When the antenna pattern 110 is disposed in the upper portion of the communication system 100, it is possible to reduce an amount of radiation radiated from the antenna pattern 110 that is absorbed by a body of a user wearing the communication system 100, thereby increasing the radiation efficiency of the communication system 100. Furthermore, since the power supply unit 130 is included in the stacked structure of the communication system 100, the capacity of the power supply unit 130 may be increased as will be described in detail with reference to FIGS. 2A and 2B below.

As described above, since the communication system 100 has a stacked structure including the antenna pattern 110 disposed in the upper portion of the communication system 100 and the power supply unit 130, the radiation efficiency of the communication system 100 and the capacity of the power supply unit 130 may be increased.

Various examples of the communication system 100 of FIG. 1 will now be described with reference to FIGS. 2A to 3B. For convenience of explanation, FIGS. 2A to 3B illustrate only elements of the communication system 100 that are related to the examples thereof. However, it will be apparent to one of ordinary skill in the art that the communication system 100 may also include other general elements. Since the communication systems 100 illustrated in FIGS. 2A to 3B are various examples of the communication system 100 of FIG. 1, the above description of FIG. 1 is also applicable to the communication systems 100 illustrated in FIGS. 2A to 3B. Thus, the descriptions of the examples of FIGS. 2A to 3B will focus on the differences between these examples and the example of FIG. 1.

Figure 2A:
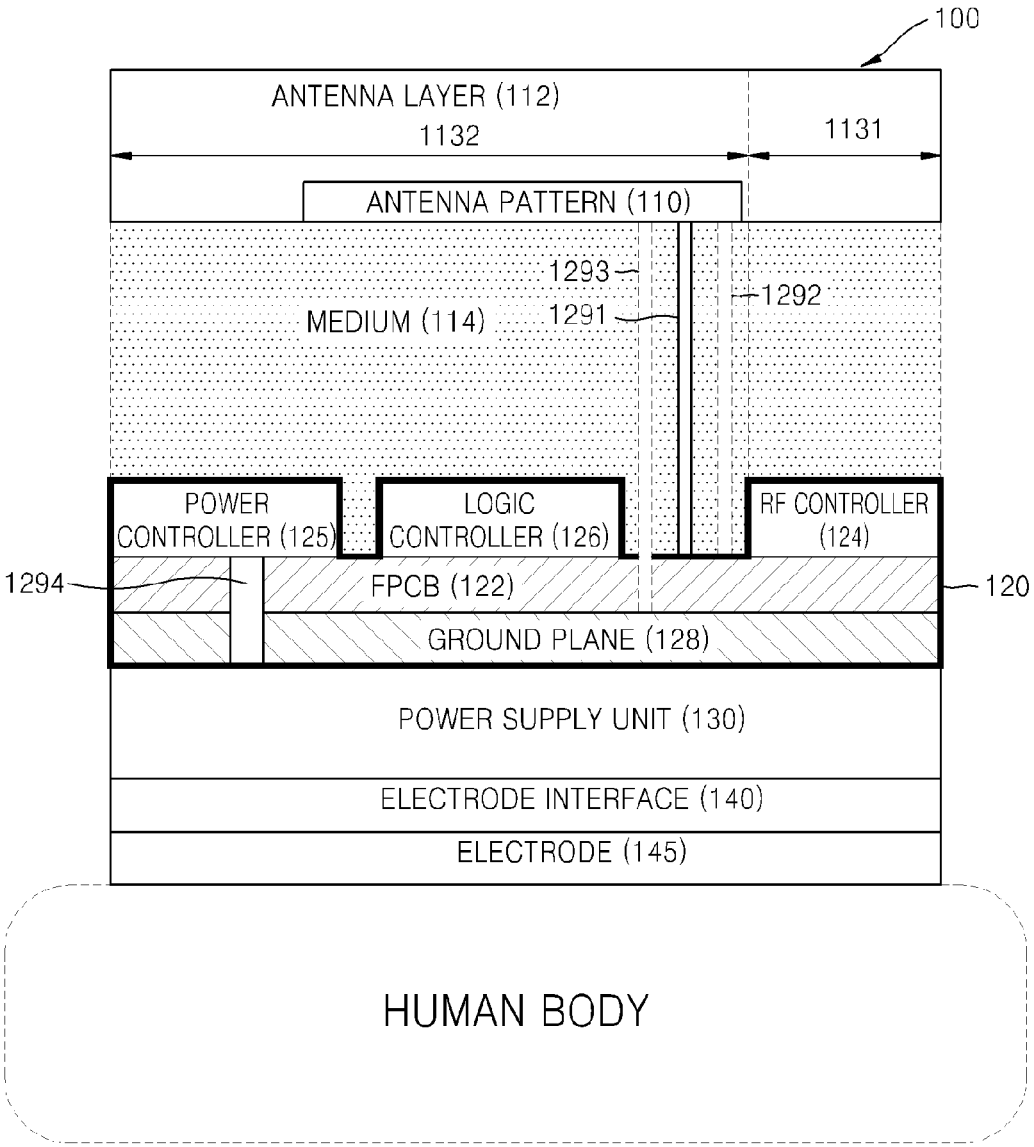
FIG. 2A is a cross-sectional block diagram of an example of the communication system of FIG. 1.

FIG. 2A is a cross-sectional block diagram of an example of the communication system 100 of FIG. 1. Referring to FIG. 2A, the communication system 100 includes an antenna pattern 110, an antenna layer 112 that includes the antenna pattern 110, a medium 114, a main board 120, at least one connection unit, e.g., first to fourth connection units 1291 to 1294, a power supply unit 130, an electrode interface 140, and an electrode 145. The main board 120 includes an FPCB 122, an RF controller 124, a power controller 125, a logic controller 126, and a ground plane 128. Although for convenience of explanation FIG. 2A illustrates that the ground plane 128 is included in the main board 120, the ground plane 128 is not limited thereto. For example, the ground plane 128 may not be included in the main board 120, and may instead be a top cover of the power supply unit 130.

When a user wears the communication system 100, the electrode 145 is disposed adjacent to the body of the user, and either the antenna layer 112 or the antenna pattern 110 included in the antenna layer 112 is disposed farthest from the body of the user.

If the communication system 100 according to the current example is based on wearable medical WBAN technology, the communication system 100 may have a thickness of about 1.5 mm or less. The antenna layer 112 may have a thickness of about 0.15 mm or less, the medium 114 may have a thickness of about 0.65 mm, and the FPCB 122 may have a thickness of about 0.15 mm, but the communication system 100 is not limited thereto.

The antenna pattern 110 transmits and receives signals. In this example, the antenna pattern 110 is included in the antenna layer 112.

The antenna layer 112 may include at least one interconnect via (not shown). The at least one interconnect via may be formed around the antenna pattern 110 and prevent a back lobe of a radiation pattern from being generated toward the body of the user due to diffraction of a signal transmitted or received via the antenna pattern 110. Thus, the radiation efficiency of the communication system 100 may be increased. The at least one interconnect via formed in the antenna layer 112 will be described in detail with reference to FIG. 7 below.

The medium 114 fills a space below the antenna pattern 110. The medium 114 may be a substrate material or some other material. More specifically, the medium 114 fills a space below the antenna layer 112 that includes the antenna pattern 110. The space below the antenna pattern 110 or the antenna layer 112 may be a space defined in the communication system 100 by the antenna layer 112 and the main board 120, but is not limited thereto, and the medium 114 may fill all spaces below the antenna layer 110 or the antenna layer 112 depending on the arrangement of elements of the communication system 100.

The communication system 100 may further include a middle interconnect layer (not shown in FIG. 2A) between the antenna layer 112 and the main board 120 to support the antenna layer 112 and to make the upper surface of the communication system 100 have a uniform height so that the communication system 100 has a flat structure. The middle interconnect layer will be described in detail with reference to FIG. 7 below.

The medium 114 may be a material selected in consideration of both a dielectric constant and a loss tangent. More specifically, the medium 114 may be a material having a low loss tangent.

If the communication system 100 is a wearable communication system, the radiation efficiency of the communication system 100 may be degraded due to electrical characteristics of a human body having high dielectric and finite conductive properties. Thus, the medium 114 that fills a space below the antenna pattern 110 may be a material having a loss tangent effective to improve the radiation efficiency of the communication system at a resonant frequency of an RF signal radiated from the antenna pattern 110.

Accordingly, the medium 114 is a material having a low loss tangent so that the radiation efficiency of the communication system 100 may be increased while the communication system 100 may have a size of about 70×25×1.5 $mm^3$ or less to correspond to the size of a wearable sensor platform.

For example, if the medium 114 is a material having a low loss tangent, it is possible to reduce an amount of energy of a signal passing through the medium 114 that is absorbed in the medium 114. In other words, if the medium 114 is a material having a low loss tangent, the radiation efficiency of the communication system 100 increases. Thus, the radiation efficiency of the communication system 100 may be increased by using a material having an appropriate dielectric constant and a low loss tangent for the medium 114.

The following Table 1 lists the dielectric constants and the loss tangents of various materials that may be used for the medium 114.

TABLE 1

| Material | Dielectric Constant | Loss Tangent |
|---|---|---|
| Polydimethylsiloxane (PDMS) | 3.1 | 0.025 |
| Kapton Polyimide | 3.3 | 0.0035 |
| RT/duroid 5880 | 2.2 | 0.0009 |
| RT/duroid 6010LM | 10.2 | 0.0023 |
| FR-4 | 4.7 | 0.025 |
| Air | 1 | 0 |

In Table 1, Kapton polyimide, RT/duroid 5880, RT/duroid 6010LM, and FR-4 are substrate materials. Kapton polyimide is manufactured by E. I. du Pont de Nemours and Company (DuPont), Wilmington, Del. RT/duroid 5880 and RT/duroid 6010LM are manufactured by Rogers Corporation, Rogers, Conn. FR-4 is a grade designation assigned to glass-reinforced epoxy laminate sheets, tubes, rods and printed circuit boards.

Referring to Table 1, Kapton polyimide has a dielectric constant that is similar to that of PDMS and has a lower loss tangent than that of PDMS, RT/duroid 5880 and RT/duroid 6010LM have a far lower loss tangent than that of PDMS, and FR-4 has a loss tangent that is similar to that of PDMS.

Thus, for example, a material having an appropriate dielectric constant and a low loss tangent may be selected from Kapton polyimide, RT/duroid 5880, RT/duroid 6010LM, FR-4, and air, but the material is not limited thereto.

The following Table 2 shows other examples of a material having an appropriate dielectric constant and a low loss tangent that may used for the medium 114. Table 2 shows a loss tangent at 3 GHz of each of these materials.

TABLE 2

| Material | Loss Tangent |
|---|---|
| Teflon | 15E−4 |
| Polyethylene | 3.1E−4 |

TABLE 2-continued

| Material | Loss Tangent |
|---|---|
| Polyolefin, Irradiated | 3E−4 |
| Polystyrene | 3.3E−4 |
| Polyvinyl Formal (Formvar) | 1.1E−2 |
| Nylon | 1.2E−2 |
| Quartz, Fused | 6E−5 |
| Pyrex Glass | 5.4E−3 |
| Water, Distilled | 1.6E−1 |

Thus, the communication system 100 may have a thin and flexible structure and is capable of reducing an amount of energy that is absorbed in the medium 114, thereby increasing the radiation efficiency of the communication system 100.

The main board 120 controls the communication system 100. For example, the main board 120 includes the FPCB 122, and the RF controller 124, the power controller 125, and the logic controller 126 adhered onto or mounted on the FPCB 122. The FPCB 122 may include the ground plane 128. In other words, the main board 120 may be a embedded passive components type board.

The RF controller 124 controls RF communication performed in the communication system 100. For example, the RF controller 124 may be an RF chip that controls the RF communication, but is not limited thereto.

In this example, the RF controller 124 is disposed in a region of the main board, and the antenna pattern 110 is disposed on the opposite side of the region of the main board 120 not to face the RF controller. Referring to FIG. 2A, as one example, the RF controller 124 of the main board 120 is disposed in a region 1131, and the antenna pattern 110 is disposed on the opposite side of the region 1131, that is a region 1132. Thus, the antenna pattern 110 is disposed on the region 1132 in which the RF controller 124 of the main board 120 is not disposed. In this example, the region 1131 in which the RF controller 124 is disposed adjoins an edge of the main board 120.

As described above, since the antenna pattern 110 is disposed on the opposite side of the region of the RF controller 124, in which the RF controller 124 is not disposed, a signal transmitted from or received by the antenna pattern 110 may be prevented from being interrupted by a signal generated during an operation of the RF controller 124.

The power controller 125 controls power supplied from the power supply unit 130. For example, the power controller 125 may be a power management integrated circuit (IC), but is not limited thereto.

The logic controller 126 controls an overall operation of the communication system 100. For example, the logic controller 126 may include an analog front end (AFE) board, a digital signal processing (DSP) chip, and a central processing unit (CPU) chip to control an overall operation of the communication system 100, but is not limited thereto.

In this example, the FPCB 122 includes the ground plane 128, but the ground plane 128 is not limited thereto, and the ground plane 128 may be a top cover of the power supply unit 130. The ground plane 128 that may be a top cover of the power supply unit 130 may be a coating on the top cover of the power supply unit 130, but the ground plane 128 is not limited thereto.

Thus, the ground plane 128 may be one of a plurality of layers of the FPCB 122, or may be a top cover of the power supply unit 130. If the ground plane 128 is included in the FPCB 122, the ground plane 128 may be located in a lower portion of the FPCB 122, but is not limited thereto.

As shown in FIG. 2A, the ground plane 128 and the power supply unit 130 are between the antenna pattern 110 and a human body wearing the communication system 100. Accordingly, the ground plane 128 and the power supply unit 130 may shield the human body from an RF signal radiated from the antenna pattern 110 to reduce an amount of energy of the RF signal that is absorbed in the human body.

The first to third connection units 1291 to 1293 connect the antenna pattern 110 to the main board 120, and the fourth connection unit 1294 connects the power controller 125 to the power supply unit 130. The first and second connection units 1291 and 1292 may be connected to a signal surface of the FPCB 122 included in the main board 120, and the third connection unit 1293 may be connected to the ground plane 128 included in the main board 120 or the power supply unit 130.

The first to fourth connection units 1291 to 1294 may be through vias formed by filling via holes with a conductive material, e.g., lead, but are not limited thereto. For example, the fourth connection unit 1294 may be a metal track.

More specifically, in this example, the antenna pattern 110 is disposed above the main board 120. Thus, the first and second connection units 1291 and 1292 are may be through vias for connecting the antenna pattern 110 to the main board 120, and the third connection unit 1293 may be a through via for connecting the antenna pattern 110 to the ground plane 128.

An RF signal output from the RF controller 124 is transmitted to the antenna pattern 110 by the first and second connection units 1291 and 1292 that connect the antenna pattern 110 to the main board 120.

FIG. 2A illustrates a case where the first and second connection units 1291 and 1292 are used when a balanced signal or a differential signal is output from the RF controller 124, but the communication system 100 is not limited thereto. When an unbalanced signal is output from the RF controller 124, only the first connection unit 1291 need be used. For convenience of explanation, a case where the first and second connection units 1291 and 1292 are used will be described below, but the communication system 100 is not limited thereto.

For example, the first and second connection units 1291 and 1292 may be pass through a space between the antenna pattern 110 and the main board 120. In this case, the space between the antenna pattern 110 and the main board 120 is filled with the medium 114.

Also, the first and second connection units 1291 and 1292 may vertically pass through the space between the antenna pattern 110 and the main board 120, but are not limited thereto.

For example, the first and second connection units 1291 and 1292 may be through vias connected to an antenna feeder (not shown) of the antenna pattern 110. In this case, the first and second connection units 1291 and 1292 may be feeding vias. When the first and second connection units 1291 and 1292 are through vias, it is possible to minimize loss in the antenna feeder, improve the radiation efficiency of the communication system 100, and minimize a design space of the communication system 100.

In addition, when the medium 114 is air, the first and second connection units 1291 and 1292 may support the antenna pattern 110 and the antenna layer 112. Thus, even if the space between the antenna layer 112 and the main board 120 is empty by using air as the medium 114, the antenna pattern 110 and the antenna layer 112 may be supported by the first and second connection units 1291 and 1292.

The communication system 100 may further include at least one connection unit, e.g., the third connection unit 1293, to connect the antenna pattern 110 to the ground plane 128. For example, the third connection unit 1293 may be a shorting pin, but is not limited thereto. The third connection unit 1293 may alternatively be a through via similar to the first and second connection units 1291 and 1292. The third connection unit 1293 may vertically pass through the space between the antenna pattern 110 and the main board 120, but is not limited thereto.

When the communication system 100 includes the third connection unit 1293, the antenna pattern 110 will have an inverted structure, making it possible to reduce the size of the communication system 100.

The fourth connection unit 1294 connects the power controller 125 to the power supply unit 130. For example, the fourth connection unit 1294 may be a power via, but is not limited thereto.

The first to third connection units 1291 to 1293 will be described in detail with reference to FIGS. 4 to 6 below.

The power supply unit 130 supplies power to the main board 120. As described above, the ground plane 128 may be a top cover of the power supply unit 130, but is not limited thereto.

For example, since the ground plane 128 may be a coating on a top cover of the power supply unit 130, the top cover of the power supply unit 130 may be the ground plane 128, but the ground plane 128 is not limited thereto.

If the top cover of the power supply unit 130 is the ground plane 128, it is possible to greatly reduce the thickness of the communication system 100.

The electrode interface 140 interfaces between the electrode 145 and the main board 120. The electrode interface 140 may serve as a lower cover of the communication system 100, but is not limited thereto.

The electrode 145 detects a signal from a human body. The electrode 145 may be adhered to the skin of a human body to detect a bio-signal from the human body. The bio-signal detected by the electrode 145 is processed by the logic controller 126.

Thus, the communication system 100 may be manufactured to be an ultra thin and small communication system having an improved radiation efficiency.

Figure 2B:
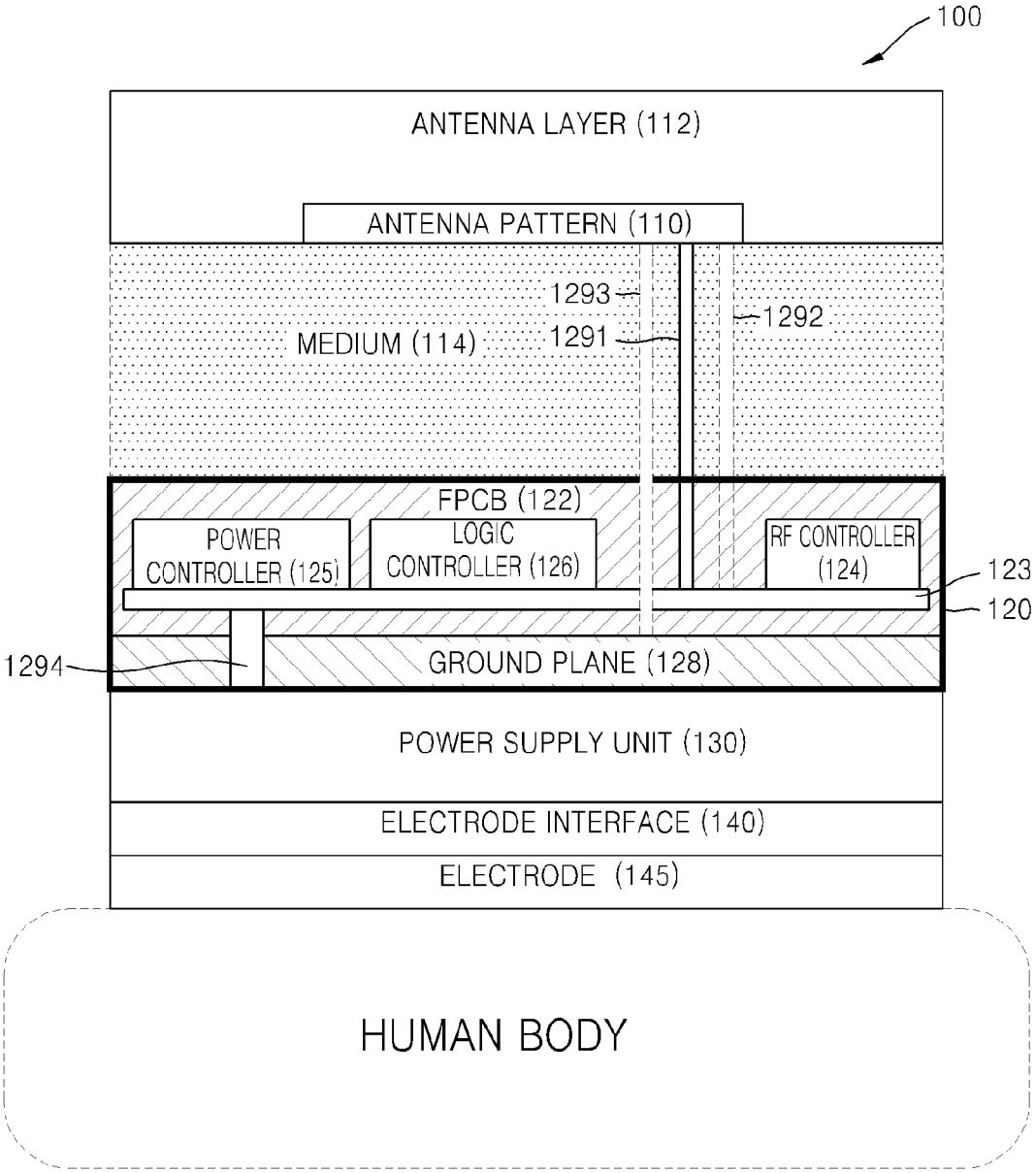
FIG. 2B is a cross-sectional block diagram of another example of the communication system of FIG. 1.

FIG. 2B is a cross-sectional block diagram of another example of the communication system 100 of FIG. 1. Referring to FIG. 2B, the communication system 100 is the same as the communication system 100 of FIG. 2A, except that a main board 120 is an active embedded board.

Referring to FIG. 2B, the main board 120 includes an FPCB 122, and an RF controller 124, a power controller 125, and a logic controller 126 inserted into or embedded in the FPCB 122. The FPCB 122 includes a ground plane 128. The main board 120 may be manufactured using an active embedding process.

The main board 120 also includes a connector 123 for connecting the RF controller 124, the power controller 125, and the logic controller 126 to one another. For example, the connector 123 may be a metal track made of a conductor, but is not limited thereto. However, instead of the connector 123, any other method known to one of ordinary skill in the art may be used to connect the RF controller 124, the power controller 125, and the logic controller 126 to one another.

The active embedding process will now be described in detail. The RF controller 124, the power controller 125, and the logic controller 126 are embedded in the FPCB 122.

Thus, the FPCB 122 may be an active-embedded FPCB including the RF controller 124, the power controller 125, and the logic controller 126.

As described above, in the communication system 100 of FIG. 2B, the RF controller 124, the power controller 125, and the logic controller 126 are inserted into or embedded in the FPCB 122, thereby greatly reducing the thickness of the communication system 100.

Figure 3A:
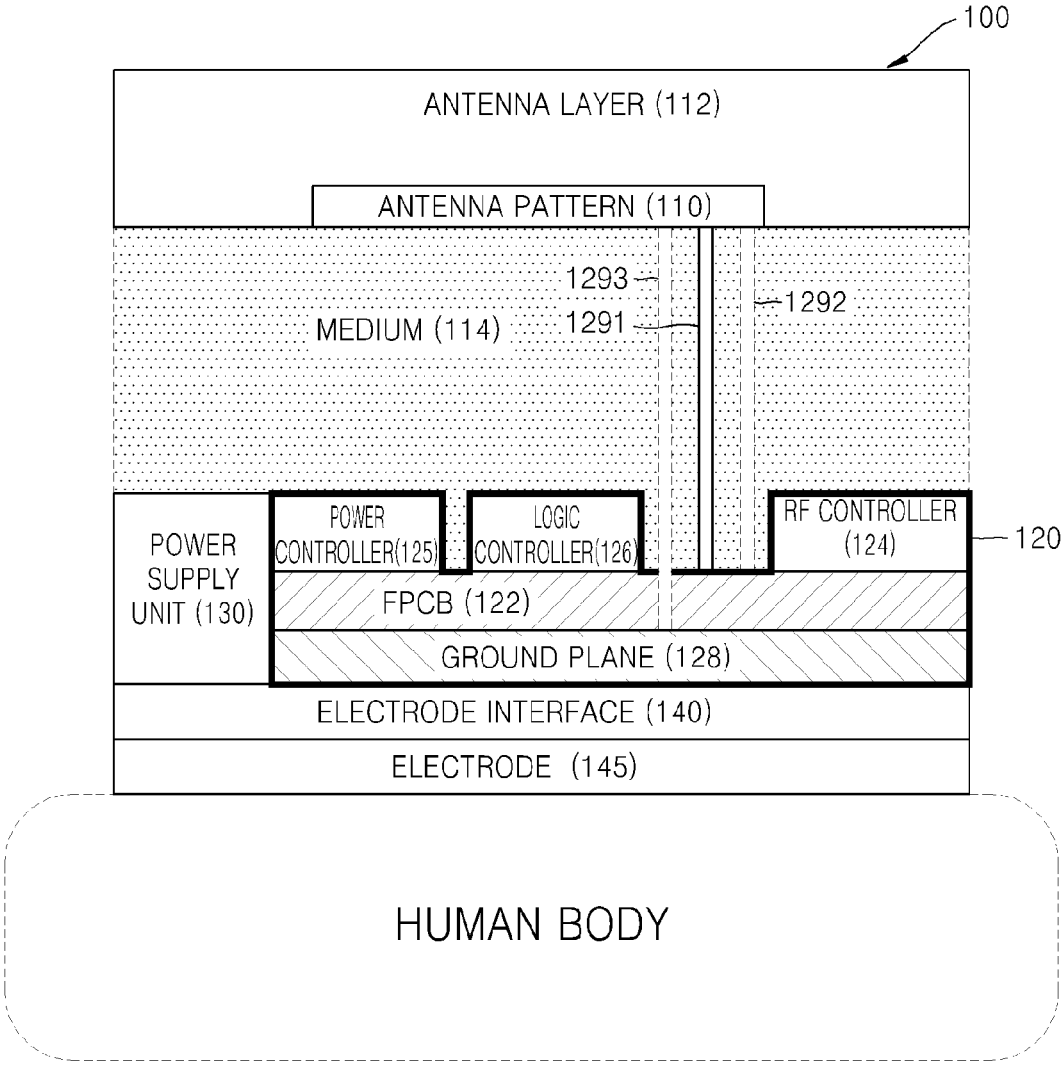
FIG. 3A is a cross-sectional block diagram of another example of the communication system of FIG. 1.

FIG. 3A is a cross-sectional block diagram of another example of the communication system 100 of FIG. 1. The communication system 100 of FIG. 3A is a variation of the communication system 100 of FIG. 2A in which the elements of the communication system 100 of FIG. 3A are arranged differently than they are in the communication system 100 of FIG. 2A. Thus, the above description of FIG. 2A is also applicable to the communication system 100 of FIG. 3A, and therefore will not be repeated here.

Referring to FIG. 3A, a main board 120 and a power supply unit 130 are arranged side-by-side, making it possible to reduce the thickness of the communication system 100. If the medium 114 in the space below the antenna layer 112 including the antenna pattern 110 is a material selected in consideration of a loss tangent as described above in connection with FIG. 2A, the radiation efficiency of the communication system 100 may be improved.

Figure 3B:
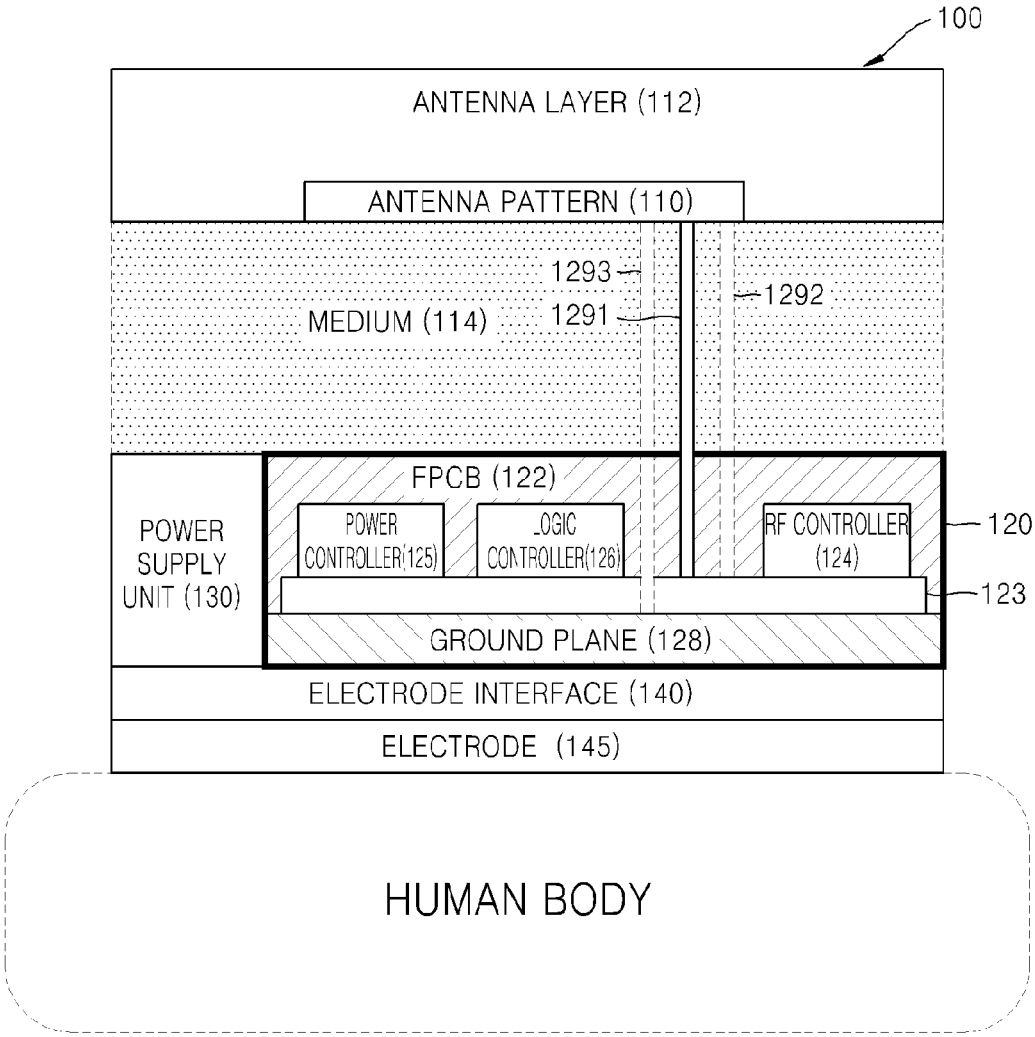
FIG. 3B is a cross-sectional block diagram of another example of the communication system of FIG. 1.

FIG. 3B is a cross-sectional block diagram of another example of the communication system 100 of FIG. 1. The communication system 100 of FIG. 3B is a variation of the communication system 100 of FIG. 2B in which the elements of the communication system 100 of FIG. 3B are arranged differently than they are in the communication system 100 of FIG. 2B. Thus, the above description of FIG. 2B is also applicable to the communication system 100 of FIG. 3B, and therefore will not be repeated here.

Also, the communication system 100 of FIG. 3B is the same as the communication system 100 of FIG. 3A except that the main board 120 of FIG. 3B is an active-embedded board. Accordingly, the communication system of FIG. 3B will be described here focusing on the differences from the communication system 100 of FIG. 3A.

Referring to FIG. 3B, the main board 120 includes an FPCB 122, and an RF controller 124, a power controller 125, and a logic controller 126 inserted into or embedded in the FPCB 122. The FPCB 122 includes a ground plane 128. In other words, the main board 120 is an active-embedded board.

The main board 120 also includes a connector 123 for connecting the RF controller 124, the power controller 125, and the logic controller 126 to one another. For example, the connector 123 may be a metal track made of a conductor, but is not limited thereto. However, instead of the connector 123, any other method known to one of ordinary skill in the art may be used to connect the RF controller 124, the power controller 125, and the logic controller 126 to one another.

As described above, in the communication system 100 of FIG. 3B, the RF controller 124, the power controller 125, and the logic controller 126 are inserted into or embedded in the FPCB 122, thereby greatly reducing the thickness of the communication system 100.

Figure 4A:
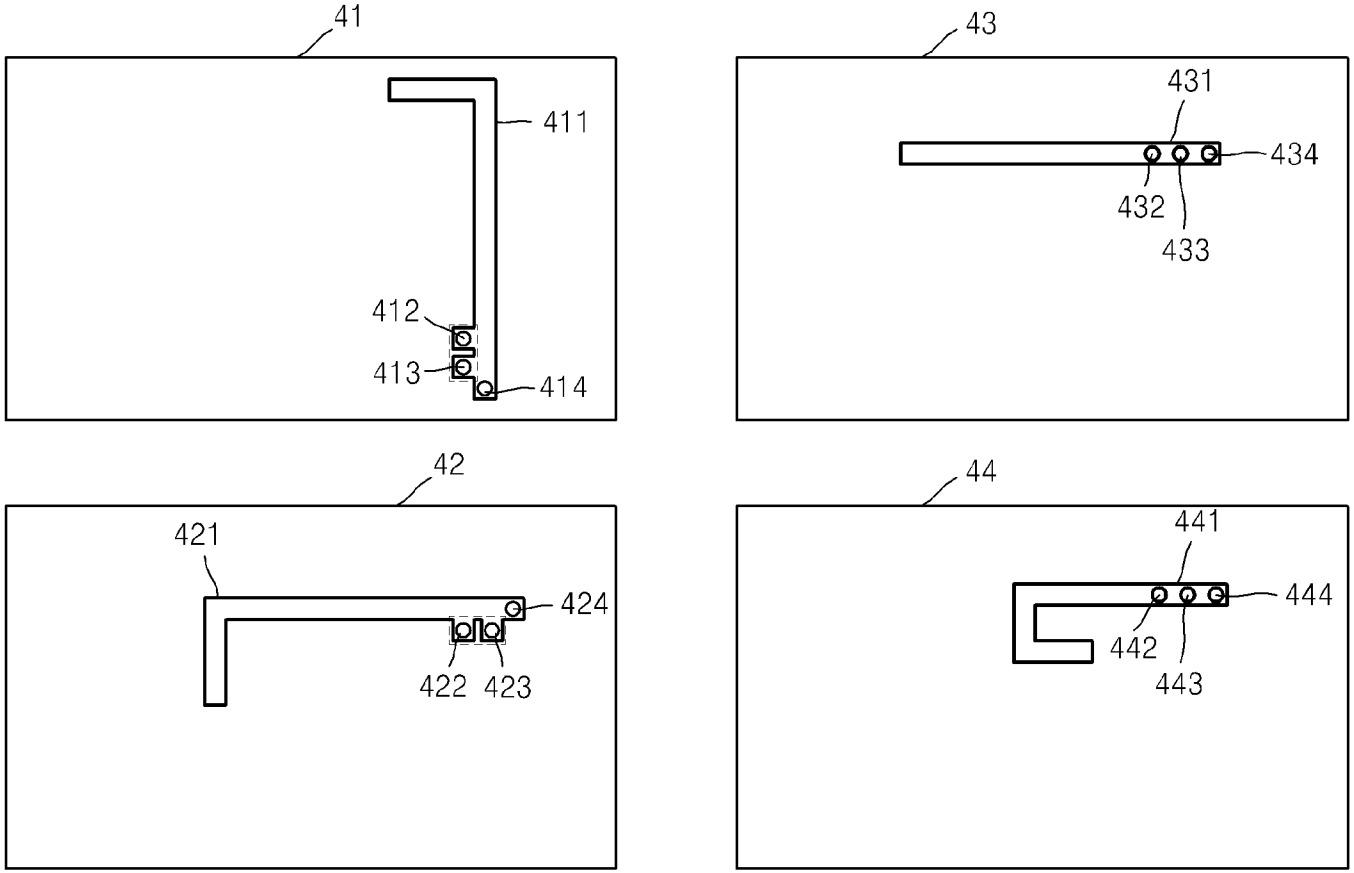
FIG. 4A illustrates examples of an antenna pattern of FIG. 1.

FIG. 4A illustrates first to fourth antenna patterns 411, 421, 431, and 441 that are examples of the antenna pattern 110 of FIG. 1. Referring to FIG. 4A, the first antenna pattern 411 is included in a first antenna layer 41, the second antenna pattern 421 is included in a second antenna layer 42, the third antenna pattern 431 is included in a third antenna layer 43, and the fourth antenna pattern 441 is included in a fourth antenna layer 44.

The first to fourth antenna patterns 411, 421, 431, and 441 are planar inverted-F antennas (PIFAs), but the antenna pattern 110 of FIG. 1 is are not limited thereto, and may be a slotted patch antenna instead as will be described in detail with reference to FIG. 4B below.

The first antenna pattern 411 includes feeders 412 to 414, the second antenna pattern 412 includes feeders 422 to 424, the third antenna pattern 413 includes feeders 432 to 434, and the fourth antenna pattern 414 includes feeders 442 to 444 to be connected to connection units (not shown). The feeders 414, 424, 434, and 444 may be connected to shorting pins, which are one example of a connection unit.

A method for connecting the feeders 412 to 414, 422 to 424, 432 to 434, and 442 to 444 of the first to fourth antenna patterns 411, 421, 431, and 441 to connection units will be described in detail with reference to FIGS. 5 and 6 below.

The first to fourth antenna patterns 411, 421, 431, and 441 may be disposed at appropriate locations in the first to fourth antenna layers 41 to 44 so that the first to fourth antenna patterns 411, 421, 431, and 441 may be disposed on the opposite side of the region of the RF controller 124 not to face the RF controller 124.

Referring to FIG. 4A, the feeders 412 to 414, 422 to 424, 432 to 434, and 442 to 444 to be connected to connection units may be respectively disposed at locations enabling the feeders 412 to 414, 422 to 424, 432 to 434, and 442 to 444 to be connected to a central region of the main board 120.

When the feeders 414, 424, 434, and 444 are connected to a ground plane 128 (not shown in FIG. 4A, but shown in FIGS. 2A-3B) via connection units, such as shorting pins, it is possible to achieve the same effect as when each of the first to fourth antenna layers 41 to 44 is lengthened.

Figure 4B:
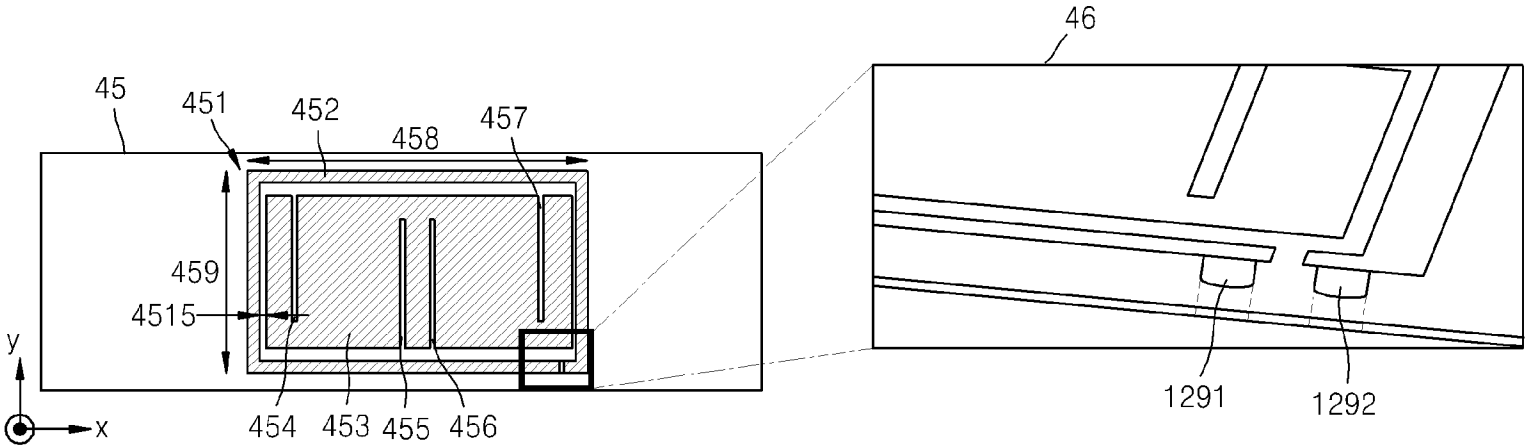
FIG. 4B illustrates another example of the antenna pattern of FIG. 1.

FIG. 4B illustrates an antenna pattern 451 that is another example of the antenna pattern 110 of FIG. 1. Specifically, FIG. 4B shows that the antenna pattern 451 is a slotted patch antenna pattern. For example, the antenna pattern 451 has an X-axis length 458 of about 36.5 mm and a Y-axis length 459 of about 20 mm, but antenna pattern 451 is not limited thereto.

Referring to a plan view 45 shown in FIG. 4B, the antenna pattern 451 includes an edge loop 452 and a main patch 453. At least one slot, e.g., slots 454 to 457, is formed in the main patch 453. In this example, the main patch 453 has a rectangular shape, but is not limited thereto. The slots 454 to 457 may be formed by punching grooves in the main patch 453, or by any other method known to one of ordinary skill in the art capable of forming grooves in the main patch 453.

The antenna pattern 451 receives an RF signal from the main board 120 via the edge loop 452. In this example, the edge loop 452 receives the RF signal from the main board 120 via first and second connection units 1291 and 1292, such as those shown in FIGS. 2A to 3B.

Referring to an expanded drawing 46 shown in FIG. 4B, the edge loop 452 is connected to the first and second connection units 1291 and 1292, and receives the RF signal from the RF controller 124 of the main board 120 via the first and second connection units 1291 and 1292. Although not shown in FIG. 4B, feeders (not shown) may be provided on the edge loop 452 to connect the edge loop 452 to the first and second connection units 1291 and 1292.

When the antenna pattern 451 is a slotted patch antenna pattern, the third connection unit 1293 illustrated in FIGS. 2A to 3B need not be used. More specifically, when the antenna pattern 451 is a slotted patch antenna pattern, a shorting pin, which is one example of the third connection unit 1293, is not be required to be connected to a ground plane 128, such as the ground plane 128 shown in FIGS.

2A-3B, but the antenna pattern 451 is not limited thereto, and the antenna pattern 451 may be a different type of antenna pattern depending on its usage.

The RF signal received by the edge loop 452 from the main board 120 is transmitted from the edge loop 452 to the main patch 453 via electromagnetic coupling between the edge loop 452 and the main patch 453 occurring in a space 4515 between the edge loop 452 and the main patch 453, and the RF signal is radiated from the antenna pattern 451.

A resonant frequency and a wavelength of the RF signal radiated from the antenna pattern 451 may be adjusted by adjusting the size of the space 4515 between the edge loop 452 and the main patch 453.

For example, if the size of the space 4515 between the edge loop 452 and the main patch 453 is increased, the wavelength of the RF signal radiated from the antenna pattern 451 increases and the resonant frequency of the RF signal decreases because the strength of the electromagnetic coupling between the edge loop 452 and the main patch 453 decreases.

If the size of the space 4515 between the edge loop 452 and the main patch 453 is decreased, the wavelength of the RF signal radiated from the antenna pattern 451 decreases and the resonant frequency increases because the strength of electromagnetic coupling between the edge loop 452 and the main patch 453 increases.

At least one slot, e.g., the slots 454 to 457, is formed in the main patch 453 of the antenna pattern 451. The slots 454 to 457 may be formed by punching grooves in the main patch 453 in a Y-axis direction from a top edge of the main patch 453 not extending to a bottom edge of the main patch 453, or from the bottom edge of the main patch 453 not extending to the top edge of the main patch 453. Alternatively, the slots 454 to 457 may be formed by any other method known to one of ordinary skill in the art capable of forming grooves in the main patch 453.

For convenience of explanation, FIG. 4B illustrates that the first and fourth slots 454 and 457 are formed in the Y-axis direction from the upper edge of the main patch 453 not extending to the bottom edge of the main patch 453, and the second and third slots 455 and 456 are formed in the Y-axis direction from the bottom edge of the main patch 453 not extending to the top edge thereof, but the main patch 453 is not limited to this particular configuration of slots.

In other words, the main patch 453 includes at least one slot, and the at least one slot may include at least one slot formed downward, at least one slot formed upward, or a combination of slots formed downward and upward according to a predetermined rule.

In the antenna pattern 451, the resonant frequency and the wavelength of the RF signal radiated from the antenna pattern 451 may be adjusted by adjusting a number of the at least one slot, e.g., the slots 454 to 457, formed in the main patch 453, a length of each of the at least one slot, e.g., the slots 454 to 457, formed in the main patch 453, and a width of each of the at least one slot, e.g., the slots 454 to 457, formed in the main patch 453.

For example, if a large number of slots are formed in the main patch 453 and at least one slot, e.g., the slots 454 to 457, which is formed in the main patch 453 is long, the wavelength of the RF signal radiated from the antenna pattern 451 increases and the resonant frequency of the RF signal decreases.

In contrast, if a small number of slots are formed in the main patch 453 and the at least one slot, e.g., the slots 454 to 457, which is formed in the main patch 453 is short, the wavelength of the RF signal radiated from the antenna pattern 451 decreases and the resonant frequency of the RF signal increases.

As described above, the size of the main patch 453 may be reduced and an RF signal with a long wavelength may be used in even a small space by providing the at least one slot, e.g., the slots 454 to 457, in the main patch 453. Thus, the size of the antenna pattern 451 may be reduced.

Also, in the antenna pattern 451, the resonant frequency and the wavelength of the RF signal radiated from the antenna pattern 451 may be adjusted by adjusting the thickness of the edge loop 451.

For example, as the thickness of the edge loop 451 is increased, the wavelength of the RF signal radiated from the antenna pattern 451 increases and the resonant frequency of the RF signal decreases.

In contrast, as the thickness of the edge loop 451 is decreased, the wavelength of the RF signal radiated from the antenna pattern 451 decreases and the resonant frequency of the RF signal increases.

As described above, the size of the antenna pattern 451 may be reduced by providing the edge loop 452 and the at least one slot, e.g., the slots 454 to 457, formed in the main patch 453. Furthermore, the resonant frequency and the wavelength of the RF signal radiated from the antenna pattern 451 may be adjusted by adjusting the width of the space 4515 between the edge loop 452 and the main patch 453, the number and the length of the at least one slot, e.g., the slots 454 to 457, formed in the main patch 453, and the thickness of the edge loop 452. As the number of the slots formed in the main patch 453 increases, the number of the resonant frequencies corresponding to each of the slots may be increased. Accordingly, an operating bandwidth of the antenna pattern 451 may be increased, because the operating bandwidth is determined based on the resonant frequencies.

Figure 5:
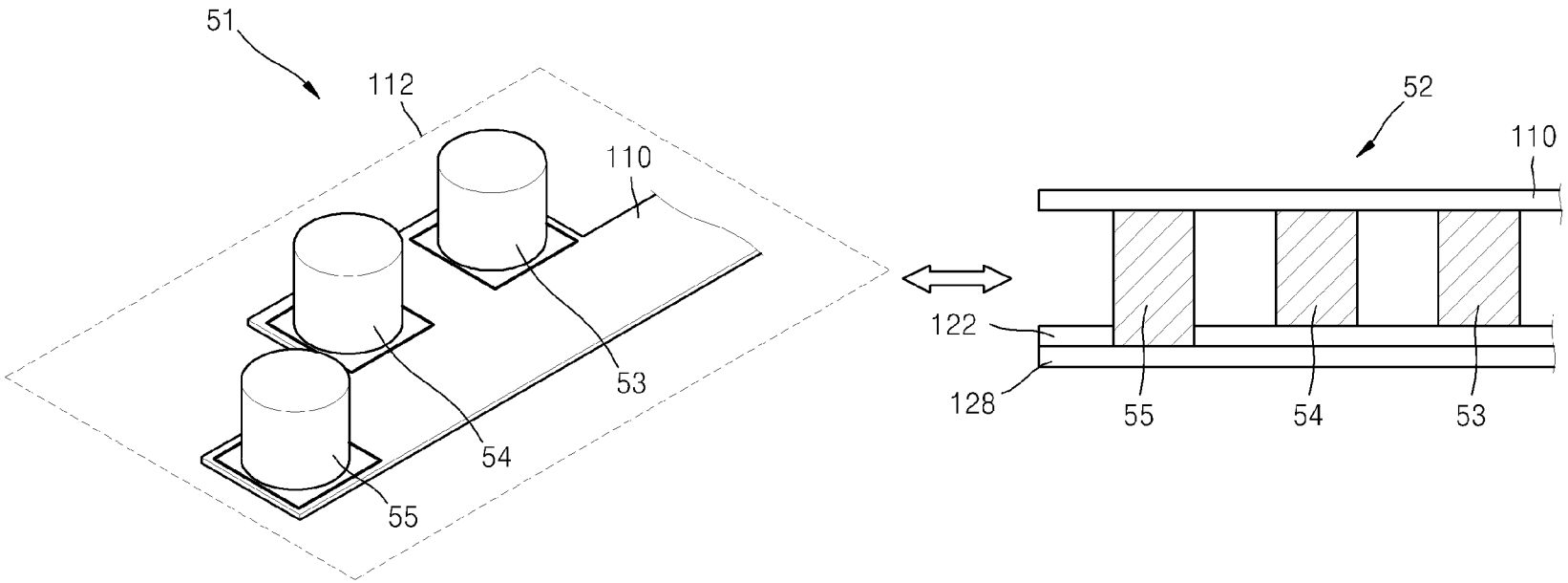
FIG. 5 illustrates an example of a method for connecting connection units to an antenna pattern of FIG. 1.

FIG. 5 is illustrates an example of a method for connecting first to third connection units 53 to 55 to the antenna pattern 110 of FIG. 1. In FIG. 5, a drawing 51 illustrates a connection of the first to third connection units 53 to 55 to an antenna pattern 110 included in an antenna layer 112. The third connection unit 55 may be a shorting pin.

Referring to a side view 52 of the first to third connection units 53 to 55 connected to the antenna pattern 110, the first and second connection units 53 and 54 are connected to an FPCB 122 of a main board 120, and the third connection unit 55 is connected to a ground plane 128.

More specifically, the antenna pattern 110 includes a via hole for forming the third connection unit 55, and the via hole may be filled with a conductive material, e.g., lead, to form a shorting pin, which is an example of the third connection unit 55. The shorting pin may be a through via to pass through a space between the antenna pattern 110 and the main board 120, but is not limited thereto.

The first to third connection units 53 to 55 may exchange signals with the antenna pattern 110 via feeders (not shown in FIG. 5) provided on the antenna pattern 110. The feeders provided on the antenna pattern 110 will now be described in detail with reference to FIG. 6.

Figure 6:
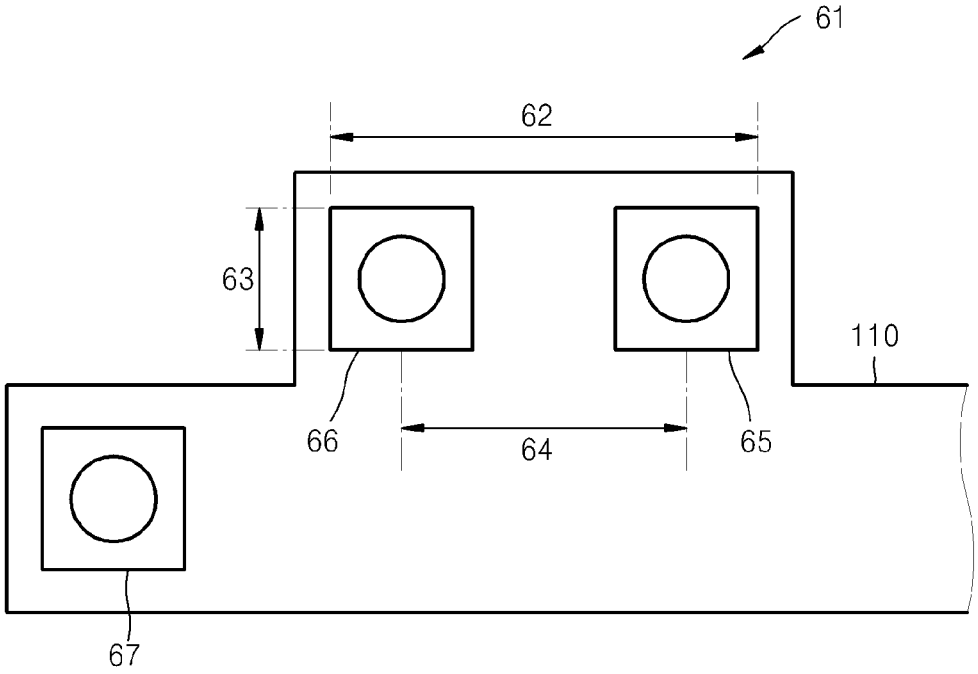
FIG. 6 illustrates an example of a structure of feeders included in the antenna pattern of FIG. 1.

FIG. 6 illustrates an example of a structure 61 of first to third feeders 65 to 67 included in the antenna pattern 110 of FIG. 1. The first to third feeders 65 to 67 are provided on the antenna pattern 110. The first and second feeders 65 and 66 are connected to the first and second connection units 53 and 54 of FIG. 5, and the third feeder 67 is connected to the third connection unit 55 of FIG. 5.

In the structure 61, the first and second feeders 65 and 66 may each have a size 63 of about 1.5 mm×1.5 mm. The first and second feeders 65 and 66 each include a hole that may have a diameter of about 1 mm, and a distance 64 between the holes may be about 2.1 mm. Thus, a total size 62 of the first and second feeders 65 and 66 may be about 3.6 mm.

The third feeder 67 has a shape that is the same as or similar to the shape of the first feeder 65 or the second feeder 66, and is provided on the antenna pattern 110.

Figure 7:
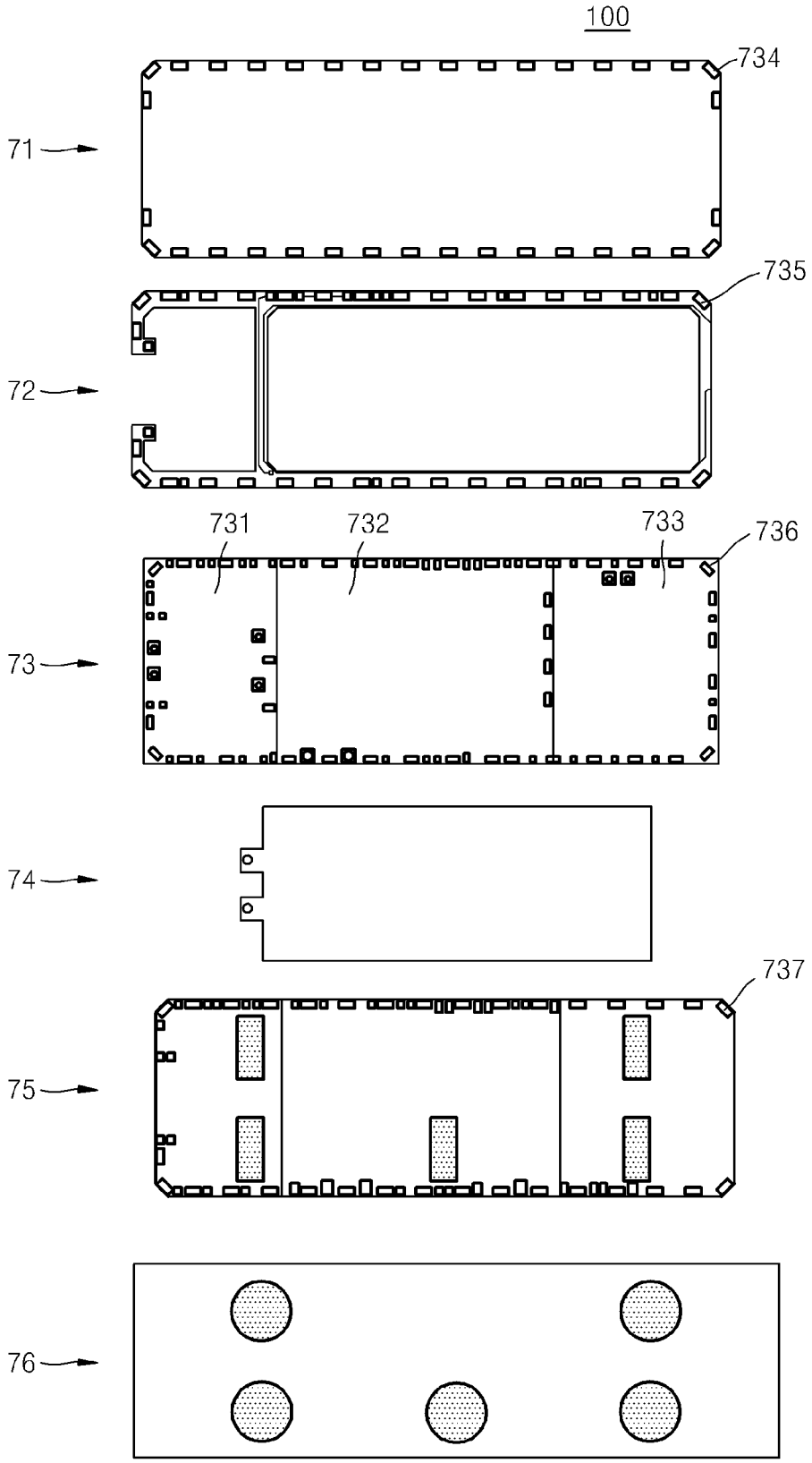
FIG. 7 illustrates an example of elements of a stacked structure of the communication system of FIG. 1.

FIG. 7 illustrates an example of elements of a stacked structure of the communication system 100 of FIG. 1. Referring to FIG. 7, the communication system 100 includes an antenna layer 71, a middle connection layer 72, a main board layer 73, a power supply layer 74, an electrode interface layer 75, and an electrode layer 76.

The antenna layer 71, the main board layer 73, the power supply layer 74, the electrode interface layer 75, and the electrode layer 76 respectively correspond to the antenna layer 112, the main board 120, the power supply unit 130, the electrode interface 140, and the electrode 145 illustrated in FIGS. 1 to 3B, and will be described focusing on the differences therebetween.

Referring to FIG. 7, the antenna layer 71 is disposed in an upper portion of the communication system 100. For example, the antenna layer 71 is disposed at an uppermost portion of the communication system 100. The antenna layer 71 may have a thickness of about 100 μm.

The middle connection layer 72 is disposed below the antenna layer 71. The middle connection layer 72 may have a thickness of about 100 μm. In greater detail, the middle connection layer 72 may be disposed between a bottom surface of the antenna layer 71 and a top surface of the main board layer 73.

To enable air to be used for the medium 114 illustrated in FIGS. 2A to 3B, the middle connection layer 72 may be used to form an air layer. Thus, by using the middle connection layer 72, it is possible to physically support the antenna layer 71, form an air layer in the medium 114, and prevent a top cover of the communication system 100 from having a radius of curvature, caused when the heights of the RF controller 124, the power controller 125, and the logic controller 126 included in the main board 120 are different from one another.

Depending on its usage, the communication system 100 may include the middle connection layer 72 or may not include the middle connection layer 72. If the communication system 100 does not include the middle connection layer 72, the antenna layer 71 may be supported by the first to third connection units 1291 to 1293 of FIGS. 2A to 3B or the interconnect via holes 734 to 737 of FIG. 7. The interconnect via holes 734 to 737 will be described in greater detail below.

The main board layer 73 is disposed below the middle connection layer 72 of the communication system 100. The main board layer 73, including the heights of elements mounted thereon, may have a thickness of about 1250 μm.

The main board layer 73 is divided into a region 731 for performing power control, a region 732 for controlling an overall operation of the communication system 100, and a region 733 for controlling RF communication, which correspond to the power controller 125, the logic controller 126, and the RF controller 124 of FIGS. 2A to 3B.

The power supply layer 74 is disposed below the main board layer 73. The power supply layer 74 may be a flexible battery. The power supply layer 74 may have a thickness of about 500 μm.

The electrode interface layer 75 is disposed below the power supply layer 74, and the electrode layer 76 is disposed below the electrode interface layer 75. The electrode interface layer 75 may be a lower cover of the communication system 100. The electrode interface layer 75 may have a thickness of about 150 μm, and the electrode layer 76 may have a thickness of about 300 μm.

Referring to FIG. 7, at least one interconnect via hole, e.g., interconnect via holes 734 to 737, may be respectively formed in the antenna layer 71, the middle connection layer 72, the main board layer 73, and the electrode interface layer 75. More specifically, at least one interconnect via hole 734 may be formed at an edge of the antenna layer 71. Similarly, at least one interconnect via hole 735, at least one interconnect via hole 736, and at least one interconnect via hole 737 may be formed at edges of the middle connection layer 72, the main board layer 73, and the electrode interface layer 75, respectively.

Thus, the antenna layer 71 and the main board layer 73 may be connected to the middle connection layer 72 via the at least one interconnect via hole 734 in the antenna layer 71, and the at least one interconnect via hole 736 in the main board layer 73.

More specifically, the at least one interconnect via hole 734 in the antenna layer 71 may be connected to the at least one interconnect via hole 735 in the middle connection layer 72, the at least one interconnect via hole 736 in the main board layer 73, and the at least one interconnect via hole 737 in the electrode interface layer 75.

However, depending on its usage, at least one interconnect via hole may also be formed in each of the power supply layer 74 and the electrode layer 76 (not shown in FIG. 7). Thus, the power supply layer 74 and the electrode layer 76 may also be connected to the antenna layer 71 via the at least one interconnect via hole formed in each of the power supply layer 74 and the electrode layer 76, but the communication system 100 is not limited thereto.

The outer surfaces of the antenna layer 71, the middle connection layer 72, the main board layer 73, and the electrode interface layer 75 may be physically connected by filling the interconnect via holes 734 to 737 with a conductive material, e.g., lead. When the outer surfaces of the antenna layer 71, the middle connection layer 72, the main board layer 73, and the electrode interface layer 75 are to be physically connected in this manner, the interconnect via holes 734 to 737 are located positions enabling through via holes to be formed.

The interconnect via holes 734 to 737 may also function as an electrical path in which a signal according to a function of the communication system 100 is transmitted.

In addition, the interconnect via holes 734 to 737 may prevent a back lobe of a radiation pattern of the antenna layer 71 from being generated toward a human body due to diffraction of a beam formed in the antenna pattern 110 due to a limited size of the communication system 100. Thus, the radiation efficiency of the communication system 100 may be increased.

Accordingly, the examples described above make it possible to reduce a size and a thickness of a wearable communication system, guarantee flexible characteristics of the wearable communication system, and increase the radiation efficiency of the wearable communication system. Also, it is possible to increase the radiation efficiency of the wearable communication system while satisfying requirements for a wearable communication system.

While this disclosure includes specific examples, it will be apparent to one of ordinary skill in the art that various changes in form and details may be made in these examples without departing from the spirit and scope of the claims and their equivalents. The examples described therein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A wearable communication system comprising:

an antenna pattern configured to transmit or receive a radio-frequency (RF) signal;

a main board configured to control the wearable communication system, and having a first side facing a body of a subject when the subject is wearing the wearable communication system; and a power supply unit configured to supply power to the main board, and having a first side facing the body of the subject when the subject is wearing the wearable communication system;

wherein the antenna pattern is disposed on a second side of the main board and a second side of the power supply unit, wherein the second side of the main board and the second side of the power supply unit are opposite their respective first sides, such that when the antenna pattern, the main board and the power supply unit are stacked, the antenna pattern is further away from the body of the subject relative to the main board or the power supply unit when the subject is wearing the wearable communication system, wherein the main board comprises an RF controller configured to control RF communication in the wearable communication system, wherein the RF controller is disposed in a region of the main board, and the antenna pattern is disposed not to face the RF controller.

2. The wearable communication system of claim 1, wherein the antenna pattern, the main board, and the power supply unit are disposed in a stack; and the antenna pattern is disposed in an upper portion of the stack.

3. The wearable communication system of claim 1, further comprising a medium disposed below the antenna pattern;

wherein the medium comprises a material having a loss tangent of less than 0.025.

4. The wearable communication system of claim 1, further comprising a medium disposed below the antenna pattern;

wherein the medium comprises any one of air, Kapton polyimide, RT/duroid 5880, RT/duroid RT 6010LM, and FR-4.

5. The wearable communication system of claim 1, further comprising a medium disposed below the antenna pattern;

wherein the medium comprises a material having a loss tangent effective to increase a radiation efficiency of the wearable communication system at a resonant frequency of an RF signal radiated from the antenna pattern.

6. The wearable communication system of claim 1, wherein the main board comprises an RF controller configured to control RF communication in the wearable communication system; and the wearable communication system further comprises at least one connection unit connecting the antenna pattern to the RF controller; and wherein the at least one connection unit passes through a space between the antenna pattern and the main board.

7. The wearable communication system of claim 1, further comprising a ground plane for the antenna pattern;

wherein the ground plane is disposed in the main board or the power supply unit.

8. The wearable communication system of claim 7, wherein the power supply unit comprises a coating on a surface of the power supply unit closest to the antenna layer; and the coating is the ground plane.

9. The wearable communication system of claim 7, further comprising at least one shorting pin connecting the antenna pattern to the ground plane.

10. The wearable communication system of claim 9, wherein the at least one shorting pin passes through a space between the antenna pattern and the main board.

11. The wearable communication system of claim 1, wherein the antenna layer further comprises at least one interconnect via hole.

12. The wearable communication system of claim 11, further comprising at least one interconnect via hole in the main board;

wherein the antenna layer is connected to the main board via the at least one interconnect via hole in the antenna layer and the at least one interconnect via hole in the main board.

13. The wearable communication system of claim 1, further comprising a middle connection layer disposed between a surface of the antenna layer closest to the main board and a surface of the main board closest to the antenna layer.

14. The wearable communication system of claim 1, wherein the antenna pattern is configured to have a unidirectional radiation pattern.

15. The wearable communication system of claim 1, wherein the antenna pattern is configured to transmit or receive the RF signal based on wireless body area network (WBAN) technology.

16. The wearable communication system of claim 1, wherein the wearable communication system has a thickness that is less than or equal to 1.5 mm.

17. The wearable communication system of claim 1, wherein the main board comprises a flexible printed circuit board (FPCB); and any one or any combination of an RF controller, a power controller, and a logic controller is inserted into or embedded in the FPCB.

18. The wearable communication system of claim 17, wherein the FPCB is an embedded FPCB in which the any one or any combination of the RF controller, the power controller, and the logic controller is embedded.

19. The wearable communication system of claim 17, wherein the main board further comprises a connector connecting the RF controller, the power controller, and the logic controller to one another.

20. The wearable communication system of claim 1, wherein the antenna pattern is a planar inverted-F antenna (PIFA) pattern or a slotted patch antenna pattern.

21. The wearable communication system of claim 1, wherein the antenna pattern is a slotted patch antenna pattern;

the slotted patch antenna pattern comprises a main patch, and an edge loop separated from the main patch by a space;

the slotted patch antenna pattern is configured to receive an RF signal from the main board via the edge loop; and a resonant frequency and a wavelength of an RF signal radiated from the slotted patch antenna pattern is adjustable by adjusting a size of the space between the edge loop and the main patch.

22. The wearable communication system of claim 1, wherein the antenna pattern is a slotted patch antenna pattern;

the slotted patch antenna pattern comprises a main patch having at least one slot, and an edge loop separated from the main patch by a space; and a resonant frequency and a wavelength of an RF signal radiated from the slotted patch antenna pattern is adjustable by adjusting a number of the at least one slot and a length of each of the at least one slot.

23. The wearable communication system of claim 1, wherein the antenna pattern is a slotted patch antenna pattern;

the slotted patch antenna pattern comprises a main patch, and an edge loop separated from the main patch by a space; and a resonant frequency and a wavelength of an RF signal radiated from the slotted patch antenna pattern is adjustable by adjusting a thickness of the edge loop of the slotted patch antenna pattern.

24. A wearable communication system configured to be wearable by a user, the wearable communication system comprising:

an antenna pattern configured to transmit and receive a radio-frequency (RF) signal;

an electrode layer configured to contact a body surface of the user when the wearable communication system is being worn by the user; and a main board configured to control the wearable communication system;

wherein the main board is disposed between the antenna pattern and the electrode layer, and is spaced apart from the antenna pattern, wherein the main board comprises an RF controller configured to control RF communication in the wearable communication system, wherein the RF controller is disposed in a region of the main board, and the antenna pattern is disposed not to face the RF controller.

25. The wearable communication system of claim 24, further comprising a power supply unit configured to supply power to the main board;

wherein the power supply unit is disposed between the main board and the electrode layer, or is disposed side-by-side with the main board.

26. The wearable communication system of claim 24, further comprising:

through via holes filled with a conductive material connecting the antenna layer to the main board;

wherein the through via holes are located along perimeters of the antenna layer and the main board.

* * * * *